US005851416A

United States Patent [19]

Raj et al.

[11] Patent Number: 5,851,416

[45] Date of Patent: Dec. 22, 1998

[54] STABLE POLYSILOXANE FERROFLUID COMPOSITIONS AND METHOD OF MAKING SAME

[75] Inventors: Kuldip Raj, Merrimack, N.H.; Ronald E. Rosensweig, Summit, N.J.; Lutful M. Aziz, Nashua, N.H.

[73] Assignee: Ferrofluidics Corporation, Nashua, N.H.

[21] Appl. No.: 798,111

[22] Filed: Feb. 12, 1997

[51] Int. Cl.[6] ..... H01F 1/44

[52] U.S. Cl. ..... 252/62.52; 252/62.54; 252/62.53

[58] Field of Search ..... 252/62.52, 62.53, 252/62.54

[56] References Cited

U.S. PATENT DOCUMENTS 3,764,540 10/1973 Khalafalla et al. ..... 252/62.52
3,917,538 11/1975 Rosensweig ..... 252/62.51
4,356,098 10/1982 Chagon ..... 252/62.52

FOREIGN PATENT DOCUMENTS 63-175401 7/1988 Japan .

OTHER PUBLICATIONS

Database WPI, *Section Ch, Week 9443,* Derwent Publications Ltd., London, GB, XP002061311, *abstract*, Sep.1994.

*Primary Examiner*—Melissa Bonner
*Attorney, Agent, or Firm*—Kudirka & Jobse, LLP

[57] ABSTRACT

A ferrofluid composition comprising a colloidal dispersion of finely divided magnetic particles in a silicone oil carrier in which the surfaces of the magnetic particles are modified with (a) a first surfactant comprising a hydrocarbon having at least one polar group and (b) a second surfactant comprising a silicone oil surfactant having at least one polar group and which is soluble in the silicone oil carrier.

7 Claims, No Drawings

STABLE POLYSILOXANE FERROFLUID COMPOSITIONS AND METHOD OF MAKING SAME

FIELD OF THE INVENTION

This invention relates to stable magnetic fluids utilizing a silicone oil carrier liquid and to a method for making the stable magnetic fluids. More particularly, this invention relates to such stable magnetic fluids which utilize a two surfactant system and a method for making such fluids.

BACKGROUND OF THE INVENTION

Magnetic liquids are referred to as ferrofluids and typically comprise a colloidal dispersion of finely-divided magnetic particles, such as iron Y-$Fe_2O_3$, magnetite, mixed metal ferrites ($MOFe_2O_3$) where M is Co, Mn, Zn or another divalent metal ion and combinations thereof, of subdomain size, for example, 10 to 300 Angstroms. The dispersion of the particles is maintained in the liquid carrier by a surfactant coating the particles. Due to thermal motion (Brownian movement of the coated particles) in the carrier, the particles are remarkably unaffected by the presence of the applied magnetic fields or other force fields, such as centrifugal or gravitational fields, and remain uniformly dispersed throughout the liquid carrier even in the presence of such fields.

Ferrofluid compositions are widely known, and typical ferrofluid compositions are described, for example, in U.S. Pat. No. 3,764,540, issued Oct. 9, 1973. Oxide ferrofluids are highly stable in contact with the atmosphere and ferrofluids containing metallic particles of Fe, Ni, Co and alloy thereof are also known in the art. Such ferrofluid compositions are utilized in a wide variety of applications, including audio voice-coil dampening, voice-coil cooling, inertia dampening apparatus, stepper motors, noise control and vacuum device seals.

Ferrofluids were originally manufactured by grinding magnetic materials in the presence of a solvent, such as a normal alkane, and a surfactant, such as oleic acid. A typical manufacturing process for these ferrofluids is described in U.S. Pat. No. 3,215,572 and an article by R. E. Rosensweig, J. W. Nestor, and R. S. Timmins entitled "Ferrohydrodynamic fluids for direct conversion of heat energy", *Materials Association for Direct Energy Conversion, Proc. Symp. AIChE—IChemE Ser.* 5, pp. 104–118, discussion pp. 133–137 (1965). In these ferrofluids, the magnetic particles are prevented from sticking to each other by the mechanism of steric repulsion, which mechanism is well-known to one skilled in colloidal science.

Ferrofluids can also be manufactured by chemical synthesis as disclosed in U.S. Pat. No. 3,764,540. The ferrofluids produced in this latter manner are sterically stabilized with absorbed surfactant. Another manufacturing process is disclosed in U.S. Pat. No. 4,329,241 which illustrates ferrofluid synthesis in an aqueous medium of particles stabilized by charge repulsion.

The surfactant which keeps the ferrofluid particles dispersed is critical in proper ferrofluid operation. Ferrofluids with multiple surfactants have been conventionally used. For example, Shimoiizaka, et al (*Journal of the Chemical Society of Japan, Chemistry and Industrial Chemistry,* No. 1 (1976) pp. 6–9) disclose ferrofluids which comprise dispersions of colloidal magnetite particles using two layers of surfactants. The first surfactant layer comprises a surfactant having a polar group. During manufacture, this surfactant chemisorbs with polar groups attached to the particle surface to coat the particles and to produce a stable sol in a hydrocarbon solvent. The coated particles are removed from solution, washed, and coated with a second layer of surfactant having polar groups. The polar groups of the second surfactant have "tails" which physically associate with "tails" of the polar groups of the first surfactant layer so that the polar groups of the second surfactant layer orient outward from the particle. Because the polar groups are hydrophilic, the double-coated particles disperse into an aqueous carrier. In another example, magnetite particles are dispersed into various diesters by addition of a nonionic surfactant as the second surfactant layer.

The use of multiple surfactants for ferrofluids is also discussed in U.S. Pat. No. 4,956,113. As disclosed in this patent, a magnetite fluid, comprising stably dispersed ferrite particles with, for example, a fatty acid surfactant in a relatively low boiling point hydrocarbon solvent, is mixed with a polyalkaline polyamine-substituted alkenylsuccinimide dispersant. The solvent is evaporated and the doubly-coated particles are mixed with a relatively high boiling point carrier liquid and additional dispersant species are added to produce a finished fluid having improved thermal behavior.

It is known that ferrofluids can be prepared using a wide variety of liquid carriers including hydrocarbons, such as kerosene or heptane; aromatics, such as toluene, xylene or styrene and diesters, such as ethylhexyl azelate; as well as other aqueous solutions, alcohols, acetates or ethers. However, present day hydrocarbon, ester and fluorocarbon based ferrofluids have been limited in some applications, because the liquid carrier generally exhibits a relatively large change in viscosity as a function of temperature.

It is also known that silicone oils (polysiloxanes) or esters, can be used as liquid carriers in ferrofluid compositions (see, for example, U.S. Pat. Nos. 3,764,540 and 4,017,694). In particular, high molecular weight polydimethyl—siloxane (PDMS) oils exhibit a relatively small change in viscosity and possess a wide thermal range of operation (they have a low freezing point and exhibit low volatility at elevated temperatures.) Therefore, ferrofluids made with PDMS oils can be used in environments where hydrocarbon, ester and fluorocarbon based ferrofluids are not readily suited.

However, long term stable and concentrated silicone oil-based ferrofluids have been difficult to synthesize in practice due, in part, to the unavailability of a satisfactory surfactant system. U.S. Pat. No. 4,356,098 discloses a ferrofluid with a silicone oil carrier which uses a single silicone oil surfactant. However, it has been found that the single silicone oil surfactant attaches poorly to the surface of the magnetic particles. In addition, the silicone oil surfactant tends to polymerize and congeal the fluid carrier so that it loses its original fluid properties.

Accordingly, it is an object of the invention to provide stable ferrofluid compositions having improved thermal properties, including stability over a wide temperature range and having a high viscosity index.

In addition, it is another object of the present invention to provide such stable ferrofluid compositions using high molecular weight silicone oil carriers, including PDMS oil carriers.

Furthermore, it is another object to provide such stable ferrofluid compositions which retain their original fluid characteristics over extended time periods and which are chemically inert during storage and use.

Stable, concentrated ferrofluid in a silicone carrier would permit broadened application; for example, in audio-voice coil and stepper motor damping, voice-coil cooling, cooling systems employing the circulation of ferrofluid, inertial damping devices, levitational inclinometers, sealing vacuum devices, and other devices and processes using ferrofluids.

SUMMARY OF THE INVENTION

In accordance with the principles of the invention, a ferrofluid comprises magnetic particles, a silicone oil carrier fluid and a two component surfactant system having an organic hydrocarbon chain terminated with one or more polar end groups and a polysiloxane terminated with a polar group moiety which includes at least one active hydrogen.

Further, in accordance with the principles of the invention, the inventive ferrofluid is prepared by forming small magnetic particles in the presence of a volatile liquid solvent stabilized with a first surfactant having one or more polar end groups. In accordance with one illustrative embodiment, the magnetic particles may be formed by precipitation, attrition or grinding. The magnetic particles so obtained have their surfaces bound to the surfactant and are suspended as a colloidal dispersion in the volatile liquid solvent.

The second surfactant is then added to the particle dispersion. In accordance with another embodiment, the second surfactant comprises a silicone oil (polysiloxane) terminating in one or more polar groups having at least one active hydrogen. The second surfactant interacts with the first surfactant to modify the surfaces of the magnetic particles in order to facilitate their suspension in a silicone oil carrier.

The volatile solvent then is removed from the dispersion by heating and evaporation to leave the surface—modified magnetic particles in a reduced volume of solvent. The silicone oil carrier, either alone or mixed with additional second surfactant, is added to the mixture containing the surface—modified magnetic particles to form the ferrofluid of this invention. The ferrofluid of this invention typically has a saturation magnetization value of up to about 200 Gauss.

DETAILED DESCRIPTION OF THE PREFERRED EMBODIMENTS

The magnetic particles employed in the ferrofluid of this invention may be any typical magnetic particles, prepared in any conventional manner such as by grinding or by precipitation, and typically are finely-divided subdomain particles comprised of magnetite, gamma iron oxide, chromium dioxide, ferrites or other similar materials, including various elements and metallic alloys. The preferred materials are magnetite ($Fe_3O_4$), gamma iron oxide ($Fe_2O_3$), and mixed ferrites wherein the magnetic particles are present usually in an amount from about 0.25% to about 10%; preferably from about 1% to about 5%, by volume of the ferrofluid.

The liquid carrier utilized in the ferrofluid of this invention comprises a silicone oil. The term "silicone oil" is a well-known term and, for the purpose of this invention comprises a liquid material of a linear polymeric structure derived from siloxane by the substitution of various organic groups for the oxygen atoms in the siloxane, wherein silicon is bonded to at least one oxygen atom in the chain. Typically such silicone oil is stable over a particular temperature range of, for example, —50° C. to 250° C., with very low viscosity change with temperature (viscosity index). The term "silicone oil" is intended to include silicone esters or other liquid silicone compounds with the above general characteristics and properties. A typical formula of a silicone oil is:

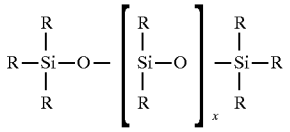

wherein R can be an aliphatic group, such as an alkyl group, preferably a methyl, ethyl or propyl radical or alkoxy group or a phenyl group, but, typically, R is a phenyl group or a methyl group, or combinations thereof. In accordance with a preferred embodiment, R is a methyl group.

Typical liquid silicone oils having a high viscosity index, include, but are not limited to: polydimethyl siloxane; polymethylphenyl siloxane; polydipropyl siloxane; polyphenyl siloxane; and other liquid silicone oils where there is a linear silicon-oxygen backbone, and wherein x has a value of from about 10 to about 10,000, and preferably from about 30 to about 200. The oil carrier can be a mixture of at least two liquid carriers.

The first surfactant of the two component surfactant system interacts with the organosilicone surfactant component to increase magnetic particle dispersion is an organosilicone oil. The latter is represented by the structural formula:

$$R''—R'—R[XH_y]_n$$

wherein $XH_y$ is a polar group including at least one active hydrogen. R' is an organic group of sufficient length and rigidity to separate the polar head $XH_y$ from the tail portion, R". R" is selected so that it is soluble in the silicone oil carrier liquid. R is an organic group that joins with the polar $XH_y$ group so that it is available to absorb onto a magnetite particle surface.

$XH_y$ can be carboxyl, amino, mercapto, hydroxyl, or another moiety, having an active hydrogen. y is 1 or 2 and n is integer of 1 to 3. Representative suitable surfactants include fatty acids, such as oleic acid, isostearic acid, arachidic acid or the like; polyphosphoric acid derivatives, such as:

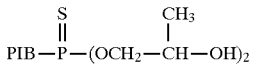

or the like; polyisobutylsuccinic anhydride (PIBSA); polyalkylenesuccinimides comprising the reaction product of PIBSA with a polyamine to form a complex mixture containing imide, amide, imidazoline and diamide esters, such as:

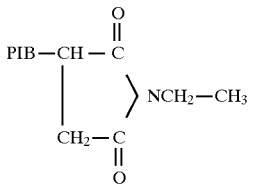

or the like, where PIB denotes polyisobutylene. The R" group is a polysiloxane-carrier-soluble tail while the XH polar head group sorbs onto the magnetic particles surfaces.

The silicone-oil type surfactants useful in preparing the improved ferrofluids of this invention are shown in the general formula as follows:

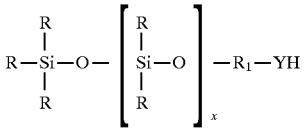

wherein $R_1$ can be an organic group, such as an aliphatic, aromatic, group or can be an inorganic or a silicone-linking group, of sufficient length to separate the solubilizing head group; for example, composed of:

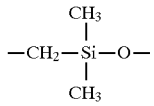

from the YH reacting group and the YH group sorbs on the magnetic particle surface.

The silicone-oil materials employed as the surfactants and dispersing agents in the present invention with a silicone-oil carrier fluid, have a functional group within the silicone-oil surfactant (typically, at one end thereof, as illustrated), that is capable of interacting with the surface of the magnetite particles. The interaction of the illustrative YH group with the particle surface may consist of the formation of a coordinational complex, a chemical reaction which forms a chemical bond or simply adsorption on the surface of the magnetite particles. The YH reactive group may be composed of one or more representative reactive or polar groups which typically include, but are not limited to: carboxylic acids (R—COOH), amines (R—$NH_2$), mercaptans (R—SH).

Alcohols (R—OH) and Other Compounds With Active Hydrogens

Thus, in practice, the solubilizing or tail groups of the silicone-oil surfactant together with the first surfactant permit a very stable dispersion by being solubilized easily in the silicone-oil carrier liquid, while the opposite end of the reacting group is sorbed onto or chemically bonded to the magnetic particles. The silicone-oil surfactant may be the same or different from the silicone-oil carrier fluid, either in molecular weight, viscosity, chain length or isometric chemical characteristics. In one preferred embodiment, Y H is the amino, —$NH_2$functional group.

Typical and specific formulas of surfactant active silicone-oil agents, which may be employed in the preparation of the improved ferrofluid, include, but are not limited to the following:

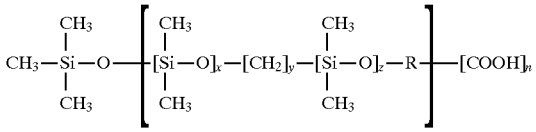

wherein n=1–3 x=1–100 y=1–100 z=1–100

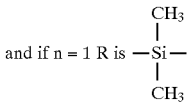

-continued

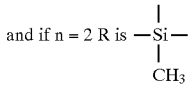

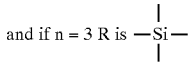

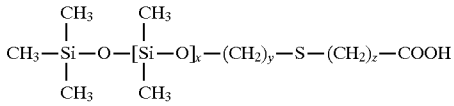

wherein x=1–1000 y=4–10 z=4–6

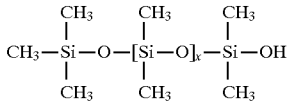

mono, di or tri hydroxy-terminated siloxanes

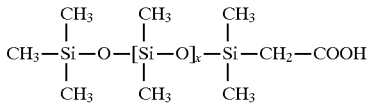

carboxylated siloxane prepared by a Grignard reaction of chlorodimethyl polysiloxane over metal then dry ice

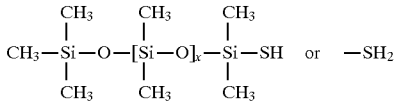

mercaptopolydimethyl siloxane

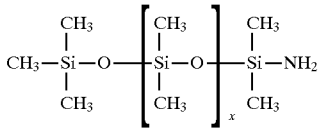

aminopolyolimethyl siloxane

The two component surfactant system is present in an amount sufficient to provide the desired colloidal dispersion and stability to the ferrofluid composition, and more typically is used in a volume ratio of total surfactant-to-magnetic-particles from about 15:1 to about 30:1.

In accordance with the process of this invention, stable ferrofluid compositions are prepared utilizing a silicone oil carrier by means of the following steps. First, particulate magnetic particles having a size less than about 500 Angstroms, usually between about 20 and about 300 Angstroms, and preferably between about 50 and 150 Angstroms are mixed with a light (volatile) hydrocarbon carrier containing a surfactant terminated with one or more polar end groups. The light hydrocarbon carrier and surfactant first are mixed and heated to a temperature between about 80° C. and about 100° C. in order to promote subsequent sorption of the surfactant on the surfaces of the magnetic particles. The magnetic particles and heated carrier-surfactant composition are then mixed for a time period which permits the surfactant to sorb on the particles surfaces, usually between about 30 and about 50 minutes, at an elevated temperature above about 120° C. and less then the boiling point of either the carrier or the surfactant.

A second surfactant, preferably mixed with silicone oil, is then added to the surface-modified magnetic particles. The surfactant is comprised of a long chain silicone polymer terminated with one or more polar groups, as described above. The resultant mixture then is heated to a temperature above about 125° C. but less than the boiling point of the mixture to allow the silicone polymer surfactant to sorb onto the magnetic particles. The first carrier then is evaporated from the mixture by heating, thus leading to the magnetic particles having two surfactants sorbed onto their surfaces in the presence of the silicone carrier.

The following examples illustrate ferrofluids and intermediate products, and methods for preparing them in accordance with the present invention, and are not intended to limit the same.

EXAMPLE 1

This example illustrates a precipitation process for producing particles of magnetic iron oxide having nominal size in the range of 80 to 100 Angstroms for use in the preparations of subsequent examples.

300 grams of ferrous sulphate salt ($FeSO_4 7H_2O$) is dissolved in 1000 ml of distilled water and mixed with 400 ml of ferric chloride solution (42 Baume, or 39 wt % 1.40 gram/m). The volume of the solution is adjusted to 2000 ml by adding water into the beaker. The mixture is heated to about 40° C. and 600 ml of ammonium hydroxide solution (260 Baume or 39 wt %) is added slowly with stirring during which the solution temperature rises to about 60° C. The mixture is soaked at this temperature for 30 minutes after which the precipitation process is complete.

EXAMPLE 2

The example illustrates a process of coating the magnetic particles with oleic acid as a dispersant.

60 ml of oleic acid (74% Emery Chemicals, Cincinnati, Ohio) is dissolved in 800 ml of heptane (Union Chemicals, Schaumburg, Ill.) and the mixture heated on a hot plate to 60° C. The heated mixture is added to the aqueous precipitate of Example 1 with stirring and the temperature is raised to 70° C. and the mixture held at this temperature for another 30 minutes to allow the oleic acid surfactant to sorb onto the surface of particles. The beaker is then removed from the hot plate and an organic phase allowed to separate from an aqueous phase. The organic layer at this stage consists of a colloidal dispersion of oleic-acid coated magnetite particles and the aqueous layer is a salt solution. For brevity, the oxide particles will be referred to hereinafter as magnetite particles, although they may actually consist of a mixture of magnetic oxide particles.

The organic layer containing the coated magnetite particles is separated from the aqueous salt layer with the aid of a magnet and a syphon. The resultant product comprises 800 ml of raw ferrofluid having a saturation ferric induction (B-H) of about 150 gauss. For convenience, the concentration is adjusted to 200 gauss by evaporation or dilution with heptane, depending on the initial concentration.

Extra surfactant, salts and very small particles are removed by mixing the base fluid with an equal volume of acetone and leaving the mixture in a pan over the poles of a permanent magnet whereby the coated particles flocculate and settle to the bottom and the top portion containing salts and small particles is decanted off. The pan is removed from the magnet poles and the particles are resuspended in heptane. This process can be repeated several times to obtain a clean ferrofluid. The finished base fluid in the process preferentially produces ferrofluid with an average particle size of 100 Angstroms as determined by a conventional method using a Colpitts oscillator.

EXAMPLE 3

This example illustrates the synthesis of a polydimethylsilicone (PDMS) based ferrofluid using as starting material the ferrofluid of Example 2.

A mixture of Dow 561 PDMS oil (viscosity 50 cp. at 27° C.) and Dow 2-8000 amino functional fluid surfactant (viscosity 308 cp. at 27° C.) with a volume ratio of oil to surfactant of 1.5 is made up. The mixture has a viscosity of about 115 cp. at 27° C. The 561 oil has a molecular weight (MW) of 3359 corresponding to a chain length of about 90 Angstroms. The surfactant 2-8000 has a chain length that is about 3 times longer than that of the oil. The mixture is heated to about 70°–80° C. so that it is ready to use. 140 ml of the oleic acid based ferrofluid procured in Example 2 is added to a separate vessel and diluted with heptane to a saturation ferric induction of 25 gauss; the volume of ferrofluid at this stage is about 1120 ml. The ferrofluid is heated to 50°–60° C. and about 120 ml of the heated PDMS mixture is added to it. The heptane is slowly evaporated with constant stirring over a period of several hours, transferring the fluid into smaller size beakers as the volume of the fluid is reduced. This process allows the attachment of the second surfactant, Dow 2-8000, to the particle under the inert atmosphere of heptane vapors. When the volume is reduced to about 200 ml (temperature in the vicinity of 100° C.) the fluid is transferred into a pan and the remaining heptane slowly evaporated with constant agitation. The final temperature of the ferrofluid in the pan is 120°–140° C. The finished ferrofluid has a saturation ferric induction of 196 gauss and a viscosity of 29,185 cp. at 27° C. On further dilution of this ferrofluid with the PDMS mixture, the ferric induction was 125 gauss at 2355 cp. This fluid then is blended with PDMS oil or with the oil surfactant mixture to obtain a lower magnetization ferrofluid of lower viscosity.

A comparison of viscosity versus temperature for synthetic hydrocarbon and silicone based ferrofluids having nominally the same viscosity at 27° C. is given in Table I. As shown therein, the variation of viscosity with temperature is greatly reduced for the silicone based ferrofluid compared to a hydrocarbon based ferrofluid. The last column in Table I lists viscosity for a PDMS oil having 500 cp. viscosity at 27° C. The data Table I show that the silicone ferrofluid is intermediate in behavior between that of the hydrocarbon ferrofluid and the neat oil. At 100° C., the ratio of viscosity of neat oil to that of hydrocarbon ferrofluid is about 6.5 to 1 and the ratio of viscosity of silicone ferrofluid to that of the hydrocarbon ferrofluid is nearly 4.9 to 1. Thus, the ferrofluids of this invention, similar to neat PDMS oil, exhibit a very small variation in viscosity compared to that of a hydrocarbon ferrofluid. The ferrofluids of this invention also exhibit a greatly reduced temperature coefficient of viscosity.

TABLE 1

| Temperature (°C.) | Hydrocarbon Ferrofluid[a] (cp.) | Silicone Ferrofluid[b] (cp.) | Silicone Oil[c] (cp.) |
|---|---|---|---|
| 0 | 2278 | 1334 | 905 |
| 27 | 500 | 509 | 500 |
| 40 | 260 | 418 | 39 |
| 60 | 107 | 260 | 277 |
| 80 | 49 | 171 | 203 |
| 100 | 24 | 117 | 155 |

[a]Standard synthetic hydrocarbon product of Ferrofluidics Corp: 200 gauss
[b]PDMS based ferrofluid of Example 3: 94 gauss. First surfactant oleic acid
[c]Blend of PDMS oils to yield 500 cp. at 27° C.

EXAMPLE 4

Following the procedure of Example 3, precipitated magnetic particles are coated with isostearic acid (Emery Chemicals, Cincinnati, Ohio) using 60 ml of the acid dissolved in 800 ml of heptane. All other conditions of temperatures, time settling etc. are as described in Example 3. Ferrofluid is obtained having a particle size of about 90–100 Angstroms and a saturation ferric induction of 200 gauss.

The ferrofluid based on the isostearic acid is then used to prepare a PDMS ferrofluid using the following procedure: A mixture of Dow 561 PDMS oil and Dow 2-8000 amino functional fluid surfactant is made up with a volume ratio of oil to surfactant of 1.8. The mixture has a viscosity of about 100 cp. at 27° C. The mixture is heated in a beaker to 70°–80° C. 100 ml of isostearic acid based ferrofluid is diluted with heptane to 25 gauss. The volume of the ferrofluid at this stage is 800 ml. The base ferrofluid is heated to 50°–60° C. and 100 ml. of the PDMS mixture is added to it. The heptane is slowly evaporated under constant steaming over several hours, transferring the fluid into smaller size beakers as the volume of the fluid is reduced. This process allows attachment of the second surfactant, Dow-2-8000, to the particles under non-oxidizing conditions as the mixture is blanketed with heptane vapors. When the volume is reduced to about 150 ml. with temperature of about 100° C., the fluid is transferred into a pan and the remaining heptane evaporated slowly under constant agitation. The final temperature of ferrofluid in the pan is 120°–140° C. The finished ferrofluid has a saturation ferric induction of 180 gauss and is paste-like at 27° C. Then the fluid is diluted with about 20 ml. of oil, its saturation ferric induction is 152 gauss and its viscosity is 7300 cp. At this stage a total of 40 ml. of surfactant is added to the heated ferrofluid in small increments while measuring the saturation ferric induction and viscosity at each step. The final product has a ferric induction of 120 gauss and a viscosity of 425 cp. at 27° C. On further dilution of this fluid with about 16 ml. of surfactant, the ferrofluid parameters were 87 gauss and 368 cp. at 27° C.

EXAMPLE 5

Following the procedures described in detail in Examples 1 and 4, but substituting polypropylene succinic anhydride (Humphrey Chemical Co., Inc., North Haven, Conn.) for isostearic acid in the preparation, a base ferrofluid containing particles coated with polypropylene succinic anhydride was prepared. The particles were coated with the second surfactant, Dow 2-8000, and a satisfactory dispersion was made into the PDMS oil, Dow 561. The finished ferrofluid has a saturation ferric induction of 133 gauss and a viscosity of 12,900 cp. at 27° C. At this stage, 40 ml. of the PDMS-Dow 2-8000 surfactant mixture was added, producing a product with parameters of 104 gauss and 512 cp. at 27° C. On further dilution of this fluid with 23 ml of oil, the ferrofluid parameters were 93 gauss and 307 cp. at 27° C.

EXAMPLE 6

This example describes the preparation of a ferrofluid based on PDMS carrier liquid in which a polyalkylene succinimide is used as the first surfactant and ball milling is utilized as a processing step.

As the first step, aqueous magnetic oxide precipitate is prepared as detailed in Example 1. The precipitate is separated from the aqueous solution in a pan using permanent magnets, then washed with water until free from salts, washed with acetoned, and then dried. Typically, this produces about 225 grams of dry magnetic particles.

Next the particles are coated with surfactant through grinding in a ball mill 50 grams of dry magnetic oxide, 20 ml. of polyalkylene succinimide (OS 11505 from Lubrizol Corporation, Wickcliffe, Ohio), and 140 ml. of heptane are loaded into a small ball mill and ground for 17 days. The ball mill measured 75 mm in inner diameter and 85 mm in length and used hardened stainless steel balls with a diameter of 6.3 mm. The ball milling produces a slurry of colloidal and oversize material. The fluid contents of the ball mill were poured into an aluminum pan and the pan placed over the poles of a permanent magnet to remove uncoated particles and large agglomerates in the manner described in Example 2. The base fluid is flocked with acetone, the acetone wash discarded, and the particles resuspended in heptane. The fluid is adjusted to 200 gauss ferric induction.

The ferrofluid based on polyalkylene succinimide is then used to prepare a PDMS ferrofluid using the following procedure: A mixture of Dow 561 PDMS oil and Dow 2-8000 amino functional fluid surfactant is made up with volume ratio of oil to surfactant of 1.5. The mixture had a viscosity of about 115 cp. at 27° C. The mixture is heated in a beaker to 70°–80° C. 5.5 ml. of the succinimide based ferrofluid is diluted with heptane to 25 gauss. The volume of the ferrofluid at this state is 44 ml. The base ferrofluid is heated to 50°–60° C. and 10 ml. of the PDMS mixture is added to it. The heptane is slowly evaporated under constant stirring over several hours. This process allows attachment of the second surfactant, Dow 2-8000, to the particles under non-oxidizing conditions as the fluid is blanketed with heptane vapors. When the volume is reduced to about 15 ml. with temperature in the vicinity of 100° C., the fluid is transferred into a small aluminum pan and the remaining heptane is evaporated slowly under constant agitation. The final temperature of the resultant ferrofluid in the pan is 120°–140° C. The finished ferrofluid has a saturation ferric induction of about 90 gauss and a viscosity of 4700 cp. at 27° C. At this point, 4 ml. of the PDMS-surfactant mixture is added to the heated ferrofluid yielding magnetic fluid parameters of 75 gauss and 942 cp. at 27° C.

EXAMPLE 7

This example illustrates that the silicone surfactant, Dow 2-8000 resists attachment to a particle surface in the absence of a first surfactant under thermal agitation. A water based ferrofluid (Ferrofluidics Corp., Nashua, N.H. catalog number EMG 605) is used as the starting material. In this fluid, the magnetic particles are coated with a proprietary cationic dispersant. The particles were flocculated with acetone and washed with acetone leaving the particle surfaces bare by the process set forth in U.S. Pat. No. 3,917,538. The particles were dried and then slurried with heptane in a beaker and heated on a hot plate. A mixture of the Dow 561 PDMS oil and the Dow 2-8000 surfactant having a volumetric ration of oil to surfactant of 1.5 was heated to 70°–80° C. and added to the slurry in the attempt to form a stable colloid at any magnetization level, following the general procedures detailed in Example 4. However, in all cases, the particles separated from the carrier and settled to the bottom of the beaker.

Based on the above example, it is clear that sorbing of the first dispersant species onto the magnetic particle surface exerts a synergistic influence on the ability of the second dispersant to attach to a particle and stably suspend the particles in PDMS oil.

EXAMPLE 8

While it is not possible to synthesize a silicone-based ferrofluid with Dow 2-8000 as first surfactant as described in Example 7 under the heat and constant stirring, attempts were made to attach the silicone surfactant by grinding process.

50 grams of an uncoated magnetite produced by the method of Example 1 and having average particle size of 100 Angstroms was added to a small ball mill together with 30 ml of Dow 2-8000 and 160 ml of low molecular weight PDMS solvent-Dow 200 fluid (0.65 cst). After nine days of grinding no colloid was formed. At this time 20 ml of additional Dow 2-8000 was added. The ball mill was run for additional 25 days. Still the surfactant did not attach and the colloid did not form.

In another experiment, 30 grams of uncoated magnetite produced by the method of Example 1 was combined with 30 ml of Dow 2-8000, 2 ml of Dow low molecular weight PDMS solvent—Dow 200 fluid (0.65 cst) and 175 ml of Dow 561 oil. The mixture was transferred into a laboratory scale attritor which was operated at 3500 rpm for 15 hours. The contents of the attritor were then removed into a pan and the fluid was concentrated by removing the solvent. The final product had a ferric induction of 68 Gauss and a viscosity of 83 cp. It was believed that the higher energy available in the attrition mill was responsible for attaching the silicone surfactant to the bare particles.

Although only a few illustrative embodiments have been disclosed, other embodiments will be apparent to those skilled in the art. For example, although a particular PDMS oil and a particular chain length of silicone dispersant is described in the above examples, it is obvious that polymers of shorter and longer chain length and possessing other polar groups may be employed within the scope of this invention. For example, the use of a dispersant having a shorter chain length is expected to yield a product that can be more highly concentrated and therefore more magnetic. These modifications and others which will be apparent to those skilled in the art are intended to be covered by the following claims.

What is claimed is:

1. A method for preparing a ferrofluid composition comprising the steps of:

(a) mixing magnetic particles with a hydrocarbon carrier containing a first surfactant that includes a hydrocarbon with at least one polar group;

(b) heating the resulting mixture of step (a) to a temperature that is sufficient to promote sorption of the surfactant on the particles;

(c) adding a silicone carrier containing a second surfactant to the mixture of step (b), the a second surfactant including a silicone oil surfactant, soluble in the silicone oil carrier that has at least one polar group with an active hydrogen;

(d) heating the mixture of step (c) to a temperature that is sufficient to allow the silicone surfactant to sorb on the particles;

(e) evaporating the hydrocarbon carrier.

2. The method of claim 1 wherein the first surfactant is a fatty acid.

3. The method of claim 1 wherein the second surfactant is selected from the group consisting of: a polyalkyl substituted linear siloxane, a polyphenyl substituted linear polysiloxane, a polyalkylpheny linear polysiloxane and mixtures thereof.

4. The method of claim 1 wherein the second surfactant is selected from the group consisting of: a polydimethyl siloxane, a polyphenyl siloxane a polyphenylmethyl siloxane and mixtures thereof.

5. The method of any one of claims 3 or 4 wherein the first surfactant is a fatty acid.

6. The method of claim 2 wherein the fatty acid is selected from the group consisting of oleic acid, isostearic acid and mixtures thereof.

7. The method of claim 5 wherein the fatty acid is selected from the group consisting of: oleic acid, isostearic acid and mixtures thereof.

* * * * *